United States Patent [19]

Natale et al.

[11] 3,976,812

[45] Aug. 24, 1976

[54] PHOTOCONDUCTIVE CELLS

[75] Inventors: Peter E. Natale; Frank C. Bennett, Jr., both of Rochester, N.Y.

[73] Assignee: Eastman Kodak Company, Rochester, N.Y.

[22] Filed: July 14, 1955

[21] Appl. No.: 521,987

[52] U.S. Cl. ..... 427/74; 252/501; 338/18

[51] Int. Cl.[2] ..... G03C 1/74

[58] Field of Search ..... 117/34; 427/74; 252/501; 338/18

[56] References Cited

UNITED STATES PATENTS 3,030,236 4/1962 Cooperstein ..... 427/74

OTHER PUBLICATIONS

Bennett, *The Chemical Formulary*, vol. 6, p. 227, Chemical Pat. Co. (1943), Brooklyn.

*Primary Examiner*—Edward A. Miller

EXEMPLARY CLAIM

1. A method of forming a photosensitive layer of lead sulfide crystals which comprises precipitating the crystals onto a seeded glass support by adding a solution of allyl-thiourea to an alkaline solution of a copper nitrate and a lead nitrate having a concentration of copper between $5 \times 10^{-5}$ and $5 \times 10^{-4}$ molar, a concentration of lead between 0.05 and 0.06 molar, and a concentration of hydroxide between 0.55 and 0.75 molar and immersing said seeded glass support in the resulting mixture.

5 Claims, 1 Drawing Figure

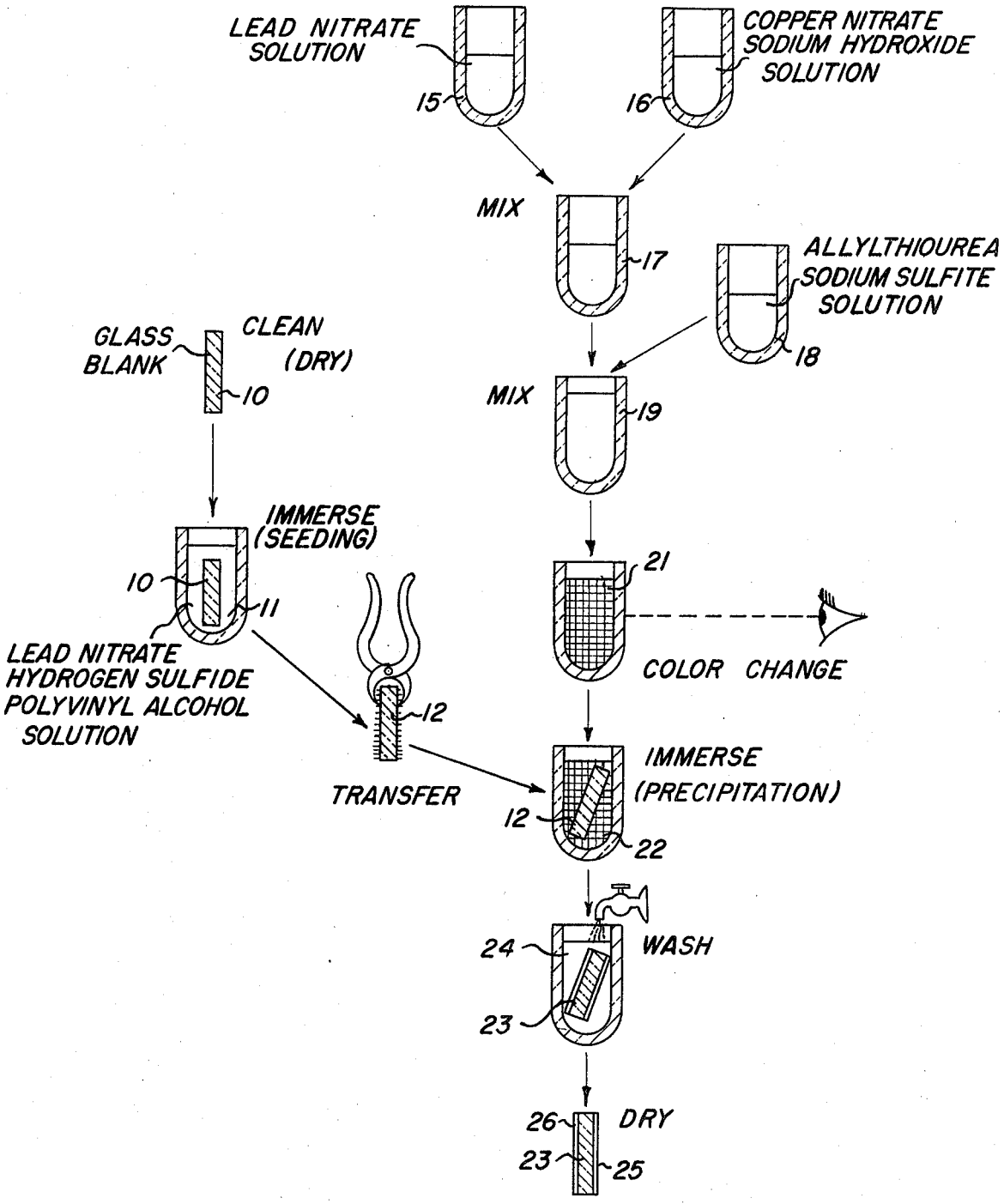
PETER E. NATALE
FRANK C. BENNETT JR.
INVENTORS
BY Daniel J. Mayne
F. M. Emerson Holmes
ATTORNEYS

PHOTOCONDUCTIVE CELLS

This invention relates to photoconductive cells and particularly to the manufacture of infrared-sensitive lead sulfide photoconductive cells.

This invention constitutes a specific improvement in the lead sulfide cells and the method of manufacture thereof described in copending applications Ser. Nos. 276,798 Hammar and Bennett, 276,799 Glassey and 276,800 Sugarman, all filed Mar. 15, 1952, and are now abandoned.

The present invention has all of the advantages of the cells described in the three patent applications referred to above and has the following additional advantages. Cells produced according to the present invention have a greater uniformity of sensitivity, even more uniform than those produced by the prior method referred to. Cells according to the present invention have about twice as much sensitivity in the infrared region beyond 3.0 microns wavelength compared to the prior cells. At room temperature the sensitivity of the present cells is somewhat less than that of the prior cells in the region between 1.0 and 3.0 microns, but either type of cell has adequate sensitivity in this region. In all of this, sensitivity is measured as a ratio of signal-to-noise in the response. Part of the noise in any infrared-sensitive system is due to the temperature of the device itself. Any cell or phosphor or other surface which is at room temperature produces some infrared radiation which contributes to the noise level whenever the device is used for measuring infrared radiation. Accordingly, when extreme sensitivity is desired, it is common practice to use any type of infrared responsive device at low temperature, for example, in contact with dry ice. one of the special advantages of the present cells compared with prior cells is that the sensitivity at dry ice temperature is about twice that of the prior cells even in the region from 1.0 to 3.0 microns as well as in the region beyond 3.0 microns wavelength.

Another extremely important factor in making infrared measurements is the so-called time constant. This refers to the response time of the cell and is usually measured in micro-seconds. The time constant of cells made according to the present invention is between 35 and 120 micro-seconds. This is considerably faster than that of the prior lead sulfide cells made by the method described in the above-mentioned pending applications. Various other characteristics of photoconductive cells have been measured. For example, reference is occasionally made to a coefficient representative of the least energy necessary to give a useful signal (the signal-to-noise ratio being taken into account). An overall description of such cells might well be given in terms of this least energy coefficient multiplied by the time constant referred to above. When such a criterion is used, the lead sulfide cells made according to the present invention are far superior to prior cells.

According to the present invention, all of the above advantages are obtained by a simple change in the formula of the precipitating solution from which the lead sulfide is precipitated onto a seeded glass surface. Until the conception of the present invention, no material was found which would give results superior to that obtained with thiourea used in the manner described in the copending applications referred to. According to the present invention allyl-thiourea ($CH_2{=}CH{-}CH_2{-}NH{-}CS{-}NH_2$) is substituted for the thiourea ($NH_2{-}CS{-}NH_2$).

The Hammar and Bennett application referred to above describes the mixing of lead nitrate solution with a copper nitrate-sodium hydroxide solution and the addition of a thiourea sodium sulfite solution to cause precipitation. According to the present invention allyl-thiourea is substituted for the thiourea in a molar concentration of about 0.65 molar in the allyl-thiourea sodium sulfite solution. A range of useful concentrations is 0.5 to 0.8 molar. In the final mix this works out to be the same range of molar concentrations as was used for thiourea. Seeding of the glass plate is preferably done according to the Sugarman system described in Ser. No. 276,800 mentioned above. The immersion of the seeded plate in the precipitating mixture is preferable according to the Glassey cycle described in Ser. No. 276,799 mentioned above. The overall system, except for the substitution of allyl-thiourea for thiourea is preferably according to the process, and using the materials, described in the Hammar and Bennett case Ser. No. 276,798 mentioned above. Fundamentally, a highly alkaline solution containing lead ion and copper ion is thoroughly mixed and then a solution of allyl-thiourea and sodium sulfite is added to cause a precipitation of lead sulfide.

EXAMPLE 1

The preferred mixture prior to precipitation is as follows:

10 milliliters distilled water
60 milliliters of 0.00169 molar cupric nitrate
50 milliliters of 0.3 molar lead nitrate
50 milliliters of 3.5 molar sodium hydroxide The above solution is mixed and allowed to stand for at least 1 hour in a constant temperature bath at 30°C. 7.63 grams of allyl-thiourea and 0.5 grams of sodium sulfite are dissolved in 100 milliliters of distilled water, warmed to about 70°C to 80°C. This high temperature is merely to insure the solution of the allyl-thiourea. The sodium sulfite is not absolutely necessary, but is preferably between 0 and 1 gram in this 100 milliliter solution. Before mixing this solution with the lead-ion-cupric-ion solution, the allyl-thiourea solution is cooled to 30°C.

The allyl-thiourea mixture is then quickly poured into the main body of the mix and stirred well before being poured into separate vials which are placed in a 30°C bath. The deposition solutions are allowed to turn black as taught by Glassey in his pending application mentioned above (a delay of from 5 minutes to an hour or even 3 hours allows the automatic seeding effect to become ineffective as discussed by Glassey). Then seeded plates are placed into each vial and allowed to remain undisturbed for 15 minutes with one face tipped at least partly downward. Following this the slides are removed and washed with water to remove any excess loosely deposited lead sulfide.

These plates reach their highest level of performance and stability on aging and the aging process can be hastened by placing the cells in a 40°C incubator for several days.

The accompanying drawing is a flow chart illustrating schematically a process for the manufacture of lead sulfide cells according to a preferred embodiment (Example 2) of the invention.

The essential novelty of the present invention appears in the steps as illustrated near the top of the diagram. The method by which the glass blank is seeded prior to precipitation is not a critical part of the present invention, but the particular form illustrated is the preferred one as described in the copending Sugarman case referred to above.

EXAMPLE 2

When added to a copper nitrate solution in the ratio of 240 ml. of a .00057M copper nitrate solution and 100 ml. of sodium hydroxide solution containing 140 grams of sodium hydroxide per liter it constitutes solution 16. To this alkaline solution 16 is added 100 ml. of fresh lead nitrate solution 15 containing 100 grams per liter. The mixture 17 is held at 23°C in the specific example given, but the process operates equally well at other temperatures between 5°C and 40°C provided the reaction times are selected in accordance with the temperature. The present example is given for a temperature of 23°C which, of course, is easy to maintain. An allyl-thiourea sodium sulfite solution 18 is made up by saturating 100 ml. of water with allyl-thiourea at 23°C to which is added one gram of anhydrous sodium sulfite. This is poured into the lead alkali solution 17 along with 10 ml. of lead sulfide solution, according to the Sugarman application mentioned above, to form the mixture 19 which, at first, is amber but which within an hour (up to three hours) darkens to gold, then brown, and just before it turns almost black, as indicated at 21 in the diagram, a seeded plate 12 is immersed in the solution which is quite black during the interval of 40 to 60 minutes, which is the preferred time for the plate 12 to remain immersed in the precipitating solution. Useful cells are obtained in coating times of 10 to 30 minutes.

As shown in the diagram, a glass blank 10 is first cleaned thoroughly, for example by treatment with sodium dichromate and sulfuric acid, followed by rinsing with distilled water and preferably then dried. The blank 10 is then immersed in a seeding solution containing a lead salt, hydrogen sulfide and a stabilizing agent for stabilizing the lead sulfide in a colloidal solution which agent, in this case, is polyvinyl alcohol which also acts as a wetting agent. The clean plate 10 remains in the seeding solution 11 for a period of 2 hours or more, after which the seeded plate 12 is transferred at the proper time to the precipitating solution 22.

The seeded plate rests at an angle in the precipitating solution so that at least one surface receives precipitated crystals thereon in a direction unaided by gravity. That is, the upper surface receives direct crystallization plus some crystals deposited by the settling of the precipitate in the solution, whereas the under surface of the plate 12 receives only those crystals which crystallize out directly onto a surface. Since the gross precipitate which settles out interferes with the formation of surfaces of the highest sensitivity, the under surface becomes the more sensitive one and, to be sure of uniformly high sensitivity, it is desirable not to agitate or disturb the solution during the coating action. It is usually more convenient to wash the coated plate 23 in the test tube or vial rather than lift it from the test tube after the completion of the coating operation. This is illustrated in the diagram by a tap from which water 24 is flowing into the test tube for washing the plate 23. The plate is then dried and ready for use.

The surface 25, which was the under surface during the precipitation, is the more sensitive one. The other surface which faced more or less upward during precipitation receives a layer 26 which is less sensitive due to the physical action of the gross precipitate while the crystals are forming. Any loosely adhering crystals on the sensitive side 25 are gently removed by careful swabbing by a camel's hair brush before the plate is dried. The sooty coating on the side 26 may be removed by swabbing with cotton dampened with hydrochloric acid. The resulting sensitive surface is quite durable to reasonable temperature changes and to a reasonable amount of handling, but, of course, small scratches or the like due to mishandling result in a photoconductive cell likely to produce excessive noise in any photoelectric system in which it is used. As pointed out in the copending applications, the ratio of lead salt to sodium hydroxide and the ratio of copper to lead in the precipitating solution must be held within certain limits, but these are not the novel features of the present invention.

The allyl-thiourea feature produces cells having the following characteristics: (1) Greater sensitivity even at room temperature, to wavelengths greater than 3.1 microns. (2) Time constants from 35 to 120 microseconds which is considerably faster than straight thiourea cells. (3) An increase of over 100 times the sensitivity when cooled to −60°C, without increasing the time constant beyond that of straight thiourea cells at room temperature. (4) The minimum energy input to give useful response is quite low and when multiplied by the time constant, the resulting coefficient is much lower and hence much superior to that of straight thiourea cells.

While we have discussed the preferred ranges for each characteristic of our invention, it is to be understood that the invention is of the scope of the following claims:

We claim:

1. A method of forming a photosensitive layer of lead sulfide crystals which comprises precipitating the crystals onto a seeded glass support by adding a solution of allyl-thiourea to an alkaline solution of a copper nitrate and a lead nitrate having a concentration of copper between $5 \times 10^{-5}$ and $5 \times 10^{-4}$ molar, a concentration of lead between 0.05 and 0.06 molar, and a concentration of hydroxide between 0.55 and 0.75 molar and immersing said seeded glass support in the resulting mixture.

2. A method of forming a photosensitive layer of lead sulfide crystals which comprises precipitating the crystals onto a seeded glass support by adding a concentrated aqueous solution of allyl-thiourea to an alkaline solution of copper nitrate and lead nitrate having a concentration of copper between $5 \times 10^{-5}$ and $5 \times 10^{-4}$ molar, a concentration of lead between 0.05 and 0.06 molar, and a concentration of hydroxide between 0.55 and 0.75 molar and immersing said seeded glass support in the resulting mixture.

3. The method of forming a photosensitive layer on a clean glass surface which comprises seeding the surface slowly in a stabilized colloidal solution of lead sulfide, preparing a second solution by adding a lead nitrate solution to a copper nitrate solution containing a concentration of copper between $5 \times 10^{-5}$ and $5 \times 10^{-4}$ molar, a concentration of lead between 0.05 and 0.06 molar and a concentration of hydroxide between 0.55 and 0.75 molar, pouring a solution of allyl-thiourea into said second solution, then immersing therein the seeded surface to receive precipitated crystals of lead sulfide with a trace of copper sulfide and then drying the surface.

4. The method of forming a uniform highly sensitive layer of lead sulfide crystals which comprises adding a concentrated aqueous solution of allyl-thiourea to a solution of lead nitrate at a temperature between 5°C and 40°C, allowing the mixture to stand from 5 minutes to three hours which is beyond the period of normal automatic seeding and then immersing a preseeded glass plate in the mixture for a period of time between 10 and 100 minutes, then washing and drying the crystal coated plate.

5. The method of forming a uniform highly sensitive layer of lead sulfide crystals which comprises adding a concentrated aqueous solution of allyl-thiourea containing sodium sulfite to a solution of lead nitrate at a temperature between 5°C and 40°C, allowing the mixture to pass through the period of normal automatic seeding and to darken due to gross precipitated lead sulfide crystals until the mixture appears black and then immersing a preseeded glass plate in the mixture for a period of time between 10 and 100 minutes, then washing and drying the crystal coated plate.

* * * * *